US009027774B2

(12) United States Patent
Palmer

(10) Patent No.: US 9,027,774 B2
(45) Date of Patent: May 12, 2015

(54) DRINKING CUP LID

(75) Inventor: Douglas Palmer, Warwick, RI (US)

(73) Assignee: Ecotop, LLC, Warwick, RI (US)

( * ) Notice: Subject to any disclaimer, the term of this patent is extended or adjusted under 35 U.S.C. 154(b) by 0 days.

(21) Appl. No.: 13/412,651

(22) Filed: Mar. 6, 2012

(65) Prior Publication Data

US 2012/0241453 A1 Sep. 27, 2012

Related U.S. Application Data

(60) Provisional application No. 61/466,511, filed on Mar. 23, 2011.

(51) Int. Cl.
*B65D 39/04* (2006.01)
*B65D 47/04* (2006.01)
*B65D 47/08* (2006.01)

(52) U.S. Cl.
CPC ..... *B65D 47/043* (2013.01); *B65D 47/0857* (2013.01)

(58) Field of Classification Search
CPC ..... B65D 51/14; B65D 39/04; B65D 39/02; B65D 39/0052
USPC ..... 220/287, 804, 801, 802, 254.3, 789, 220/254.9, 792; 215/294, 296, 320, 364
See application file for complete search history.

(56) References Cited

U.S. PATENT DOCUMENTS 481,363 A * 8/1892 Macauley ..... 215/357
521,779 A * 6/1894 Boley ..... 215/241
724,256 A * 3/1903 Brown ..... 215/357
1,842,226 A * 1/1932 Williams ..... 215/262
2,352,667 A * 7/1944 Tofanelli ..... 220/380
2,663,451 A * 12/1953 Yarnall ..... 220/805
2,674,472 A * 4/1954 Meyer ..... 215/352
2,808,276 A * 10/1957 Williams ..... 220/326
2,921,708 A * 1/1960 Henri ..... 215/230
3,422,998 A * 1/1969 Murray ..... 222/567
3,434,636 A * 3/1969 Kachman ..... 222/567
3,595,421 A * 7/1971 Sanchis ..... 215/309

(Continued)

FOREIGN PATENT DOCUMENTS

FR 2682085 A1 * 4/1993 ..... B65D 41/58
FR 2839950 A1 11/2003

(Continued)

OTHER PUBLICATIONS

"I Am Not A Paper Cup", by DCI Product, Providence, RI. http://www.dcigift.com/product.cfm?productID=763&catID=14, Mar. 26, 2012.

(Continued)

*Primary Examiner* — Fenn Mathew
*Assistant Examiner* — Chetan Chandra
(74) *Attorney, Agent, or Firm* — Barlow, Josephs & Holmes, Ltd.

(57) ABSTRACT

A drinking cup lid is disclosed. The drinking cup lid includes a body with a deck and an annular wall that depends downwards. The annular wall is adapted to insert into a drinking cup. A first gasket and a second gasket extend outward from the annular wall and are configured for sealing engagement with the drinking cup. A closure is pivotally attached to the annular wall and configured and arranged to pivot between a closed position, sealing the drinking cup closed, and an open position, opening the drinking cup.

18 Claims, 20 Drawing Sheets

(56) References Cited

U.S. PATENT DOCUMENTS

| | | | | | |
|---|---|---|---|---|---|
| 3,630,419 | A | * | 12/1971 | Pierce | 222/478 |
| 3,670,915 | A | * | 6/1972 | Forman | 215/260 |
| 3,730,399 | A | | 5/1973 | Dibrell et al. | |
| 3,926,348 | A | * | 12/1975 | Lutzker | 222/189.07 |
| 4,085,861 | A | | 4/1978 | Ruff | |
| 4,270,666 | A | * | 6/1981 | Beckman | 215/364 |
| 4,583,652 | A | * | 4/1986 | Goldberg | 215/256 |
| 4,640,434 | A | * | 2/1987 | Johnsen et al. | 220/287 |
| 4,682,707 | A | * | 7/1987 | Wiles | 220/789 |
| 4,901,881 | A | | 2/1990 | McElroy | |
| 4,928,848 | A | | 5/1990 | Ballway | |
| 4,940,135 | A | * | 7/1990 | Hall | 206/3 |
| 5,143,248 | A | | 9/1992 | Sawatsky | |
| 5,232,111 | A | * | 8/1993 | Burns | 215/320 |
| 5,395,001 | A | * | 3/1995 | Moore | 215/364 |
| 5,454,479 | A | * | 10/1995 | Kraus | 220/787 |
| 5,553,731 | A | | 9/1996 | Schuyler | |
| 5,573,139 | A | | 11/1996 | Yeh | |
| 5,749,491 | A | * | 5/1998 | Wylder et al. | 220/719 |
| 5,868,714 | A | * | 2/1999 | Danks | 604/256 |
| 5,944,208 | A | * | 8/1999 | Gale | 215/296 |
| 6,032,695 | A | * | 3/2000 | Wellen et al. | 138/89 |
| 6,036,541 | A | * | 3/2000 | Koumatsu | 439/587 |
| 6,082,576 | A | * | 7/2000 | Counts-Bradley et al. | 220/787 |
| 6,149,866 | A | * | 11/2000 | Luotola et al. | 422/401 |
| 6,230,944 | B1 | * | 5/2001 | Castellano et al. | 222/481.5 |
| 6,276,551 | B1 | | 8/2001 | Miller, II | |
| 6,360,779 | B1 | * | 3/2002 | Wagner et al. | 138/92 |
| 6,644,490 | B2 | * | 11/2003 | Clarke | 220/254.1 |
| 6,752,287 | B1 | * | 6/2004 | Lin | 220/254.9 |
| 6,758,364 | B1 | | 7/2004 | Rohrig | |
| 6,763,964 | B1 | * | 7/2004 | Hurlbut et al. | 220/254.3 |
| 6,886,707 | B2 | | 5/2005 | Giraud | |
| 6,994,326 | B1 | * | 2/2006 | Tyson | 256/1 |
| 7,114,632 | B2 | * | 10/2006 | Kraus | 220/802 |
| 7,134,564 | B2 | | 11/2006 | Verbovszky | |
| 7,185,775 | B1 | * | 3/2007 | Decal | 215/11.1 |
| 7,513,380 | B2 | * | 4/2009 | Canedo | 220/230 |
| D592,906 | S | * | 5/2009 | Allen et al. | D7/398 |
| 7,552,831 | B2 | * | 6/2009 | Catton | 215/11.1 |
| 7,658,306 | B2 | * | 2/2010 | Allen et al. | 222/481.5 |
| 2002/0046983 | A1 | * | 4/2002 | Shin et al. | 215/276 |
| 2004/0262309 | A1 | | 12/2004 | Edwards | |
| 2005/0056653 | A1 | | 3/2005 | Miller | |
| 2006/0151426 | A1 | | 7/2006 | Peters | |
| 2006/0169693 | A1 | | 8/2006 | Yeung | |
| 2007/0012698 | A1 | | 1/2007 | Durdon et al. | |
| 2007/0090081 | A1 | | 4/2007 | Briscoe et al. | |
| 2007/0145058 | A1 | | 6/2007 | Connors, Jr. et al. | |
| 2007/0170184 | A1 | * | 7/2007 | Canedo | 220/254.9 |
| 2007/0228054 | A1 | | 10/2007 | Woodhouse | |
| 2008/0272085 | A1 | * | 11/2008 | Laporta | 215/296 |
| 2012/0312816 | A1 | * | 12/2012 | Barreto et al. | 220/254.7 |

FOREIGN PATENT DOCUMENTS

| | | | | | |
|---|---|---|---|---|---|
| GB | 2171088 | A | * | 8/1986 | B65D 43/04 |
| JP | 2003170955 | A | | 6/2003 | |

OTHER PUBLICATIONS

"I Am Not A Plastic Lid" replacement lid for "I Am Not A Paper Cup". http://www.amazon.com/NOT-PLASTIC-replacement-lids-PAPER/dp/B001NZQ70S/ref=pd_bbs_sr_2?ie=UTF8&s=home-garden&qid-1236953239&sr=8-2, Mar. 26, 2012.

"We Are Happy To Serve You" Ceramic Mug by Treehugger. http://www.wearehappytoserveyou.com/, Mar. 26, 2012.

* cited by examiner

DRINKING CUP LID

CROSS-REFERENCE TO RELATED APPLICATION

This patent document claims priority to earlier filed U.S. Provisional Patent Application Ser. No. 61/466,511, filed on Mar. 23, 2011, the entire contents of which are incorporated herein by reference.

BACKGROUND OF THE INVENTION

1. Field of the Invention

The invention relates generally to drinking cup lids and more particularly to a drinking cup lid that is adapted to be secured to a drinking cup, such as a common household coffee mug, made of ceramic, glass or plastic and the like.

2. Background of the Related Art

A variety of styles of travel mugs are known in the art. These conventional travel mugs are made from plastic and metal materials and are molded and formed to exacting standards. The lids for conventional travel mugs are formed with tight tolerances so that they have an exacting fit within the mouth of their associated cup or tumbler.

Household drinking cups, such as ceramic coffee mugs, glasses and the like, generally do not come with lids, which prevents them, in most cases, from being used as travel mugs. All too often, though, a person desires to bring their favorite cup or mug with them on the road or on the ocean. However, due to the less exacting methods by which they are made (i.e. manual shaping and firing), there is a large tolerance in the dimensions, particularly in the size of the mouth opening, and thus it has been nearly impossible to design a lid which can accommodate the varying sizes and irregular inner dimensional shapes of everyday household mugs.

Therefore, there is need in the art for a device to allow a person to take the household drinking cup with them that reduces the chance of spillage while travelling and negates the need to transfer the beverage into a conventional travel mug.

SUMMARY OF THE INVENTION

The invention solves the problems of the prior art by providing a drinking cup lid particularly adapted for attaching to a ceramic or glass household drinking cup or mug. The drinking cup lid includes a body with a deck and an annular wall that depends downwards. The drinking cup lid includes first and second, oversized annular gaskets which can accommodate the varying dimensions and irregular inner surfaces of ceramic and glass cups and mugs. The first and second gaskets extend outward from the annular wall and are configured for sealing engagement with the inner wall of the mouth of the drinking cup. A closure is pivotally attached to the annular wall and configured and arranged to pivot between a closed position, sealing the drinking cup closed, and an open position, opening the drinking cup. In this manner, a conventional household drinking cup may be easily adapted for travel without transferring the beverage into a separate travel mug or risking spilling the beverage.

DETAILED DESCRIPTION OF THE PREFERRED EMBODIMENT

Figure 1:
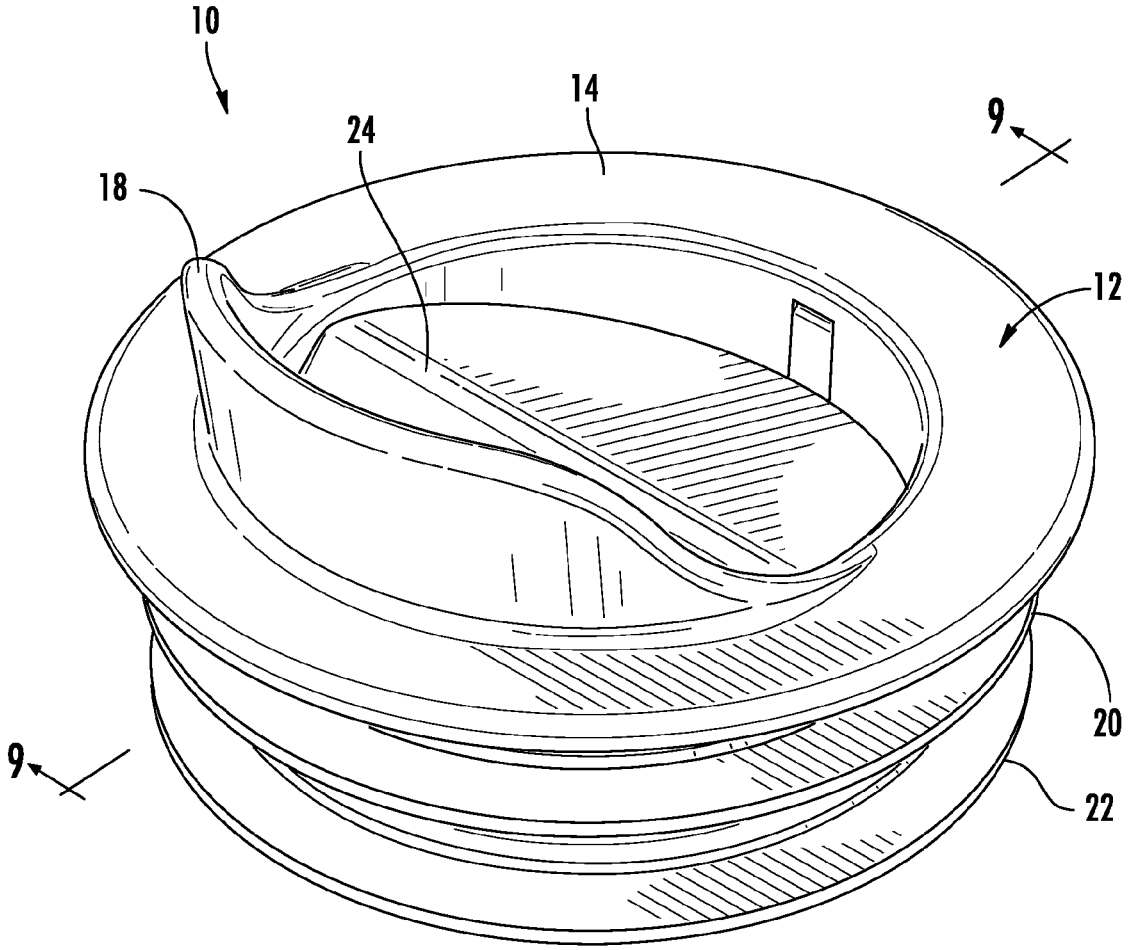
FIG. 1 is a front perspective view of a first embodiment of a drinking cup lid constructed in accordance with the teachings of the present invention.
Figure 2:
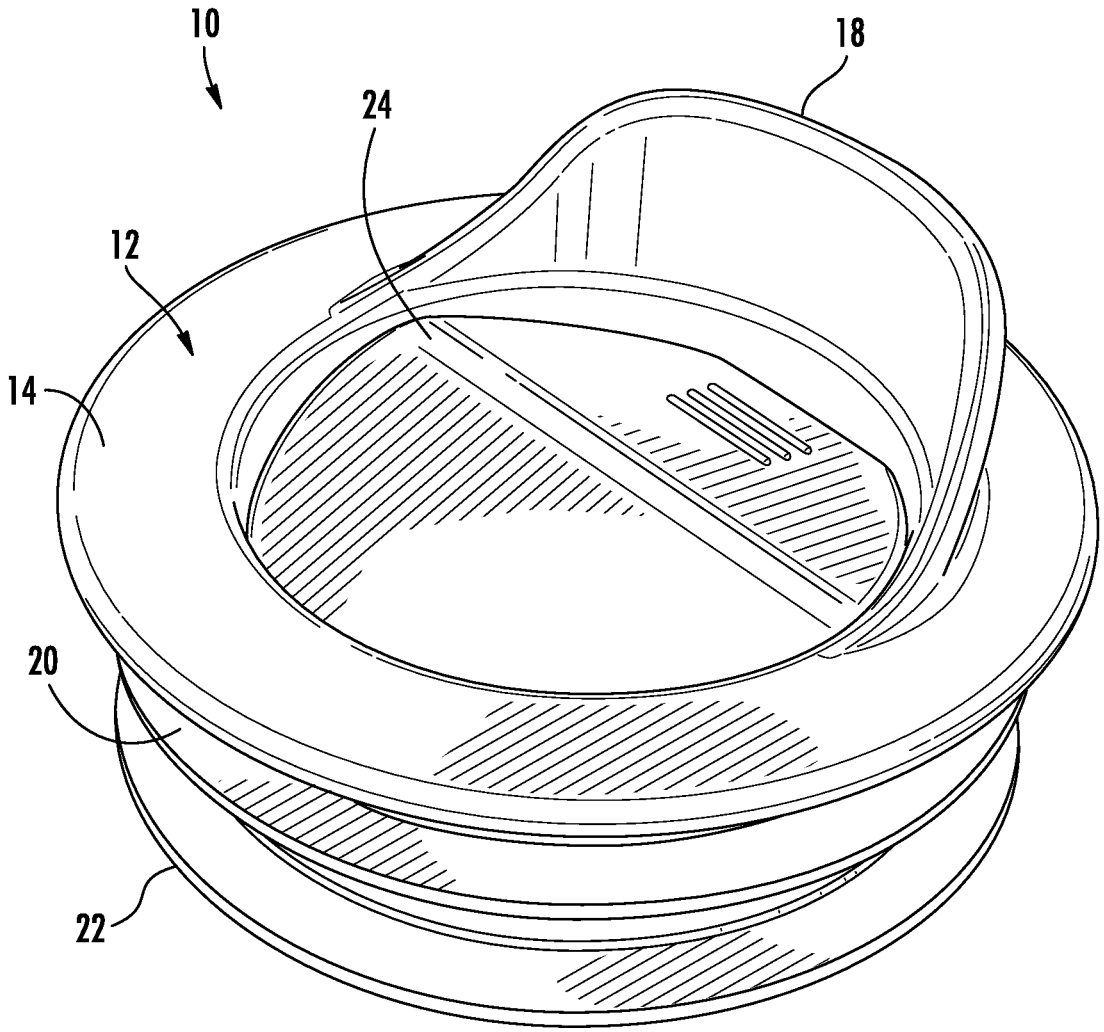
FIG. 2 is a rear perspective view thereof.
Figure 3:
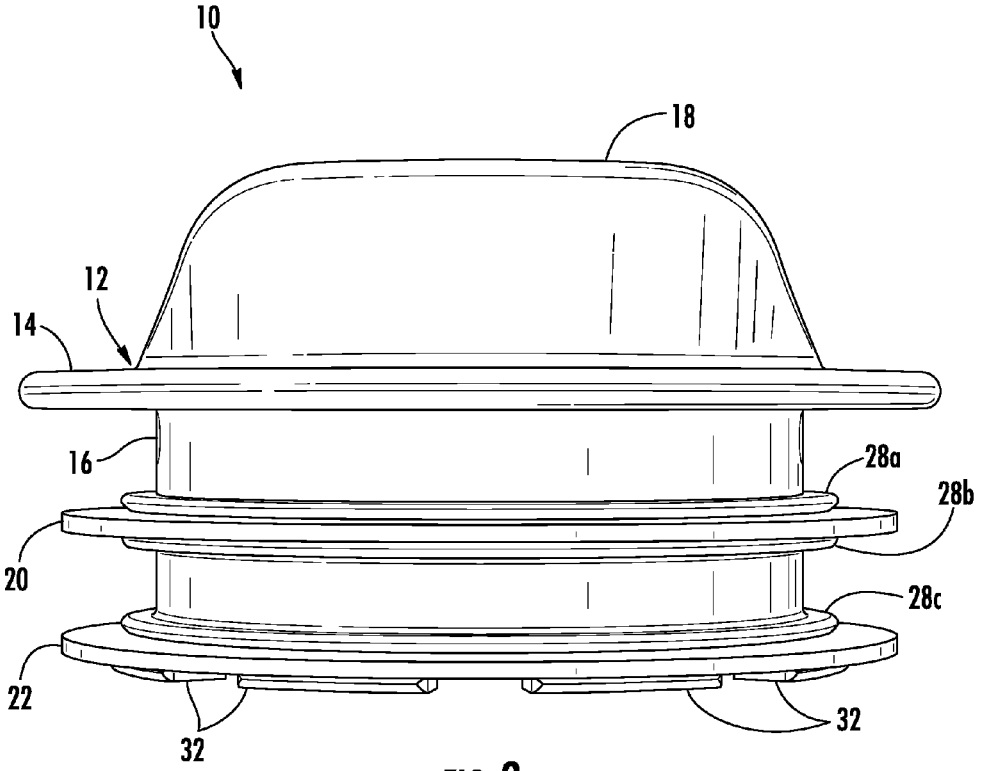
FIG. 3 is a front elevation view thereof.
Figure 4:
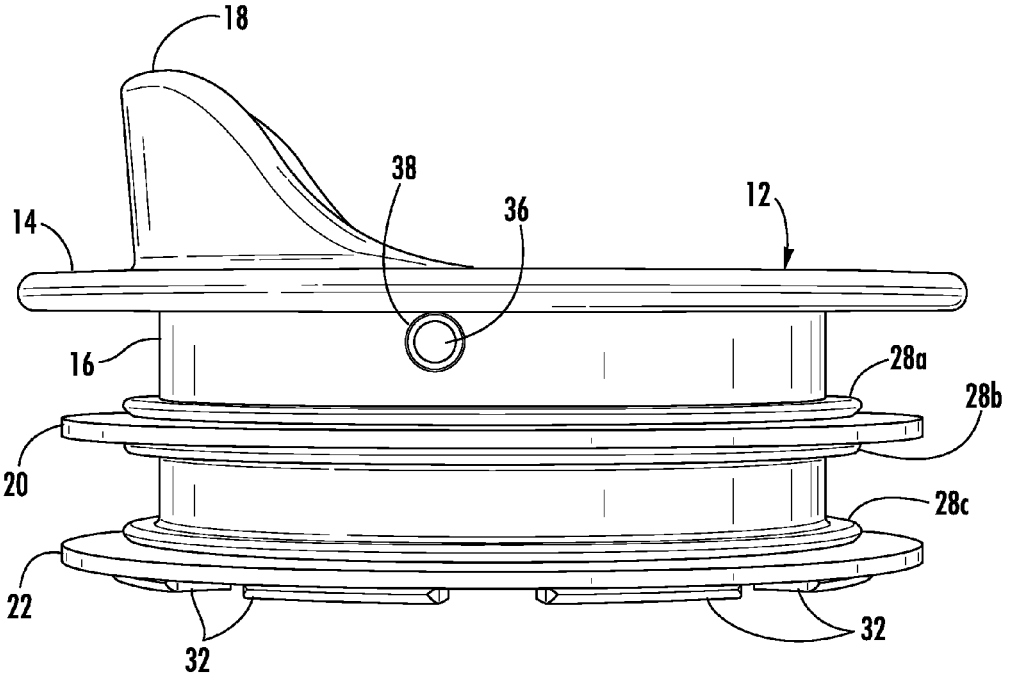
FIG. 4 is a right side elevation view thereof.
Figure 5:
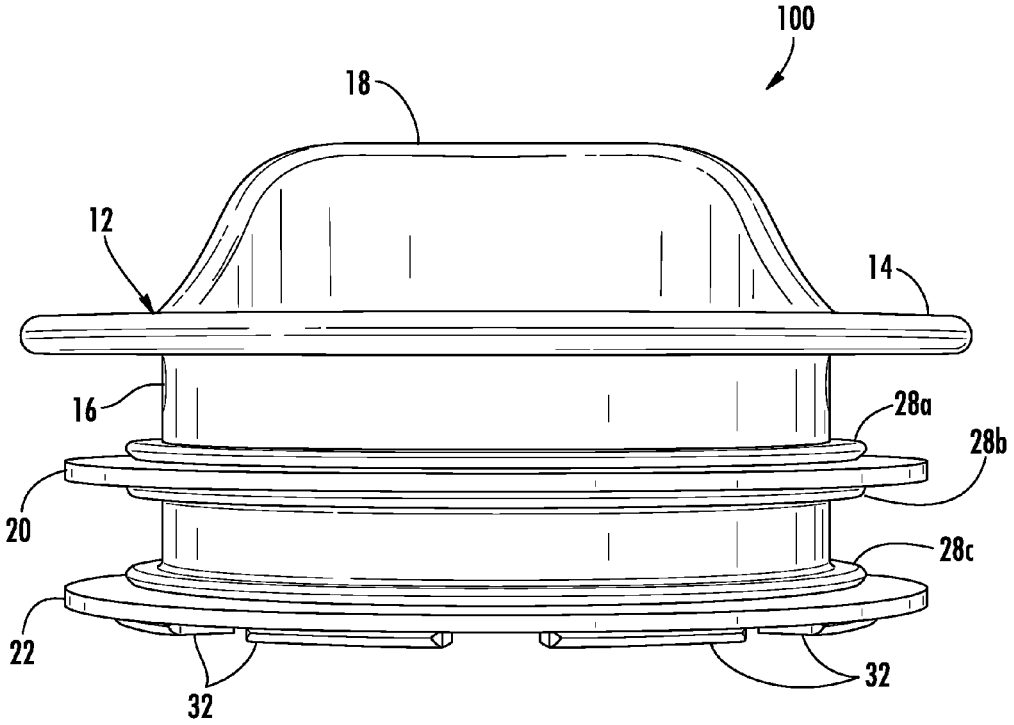
FIG. 5 is a rear elevation view thereof.
Figure 6:
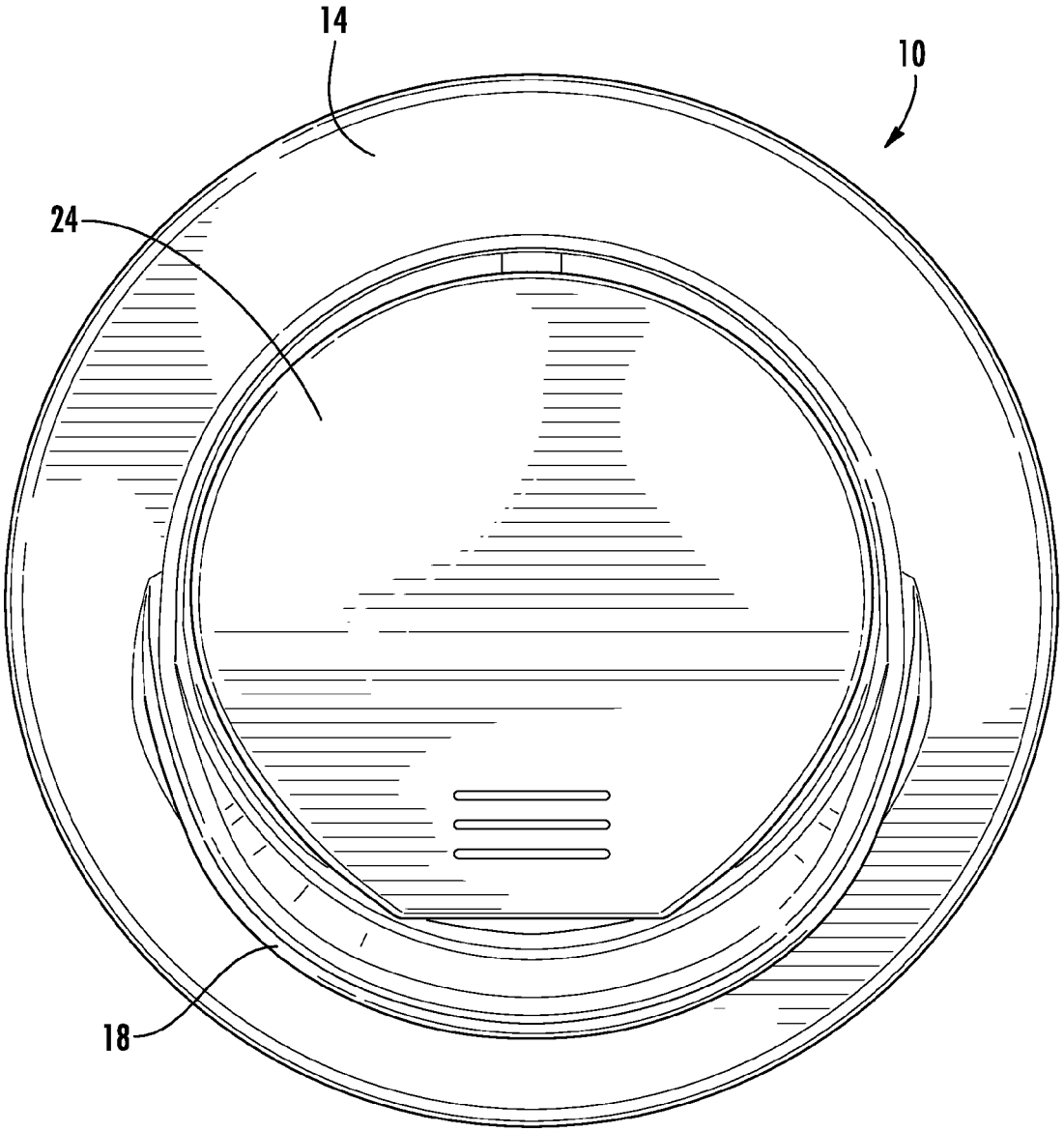
FIG. 6 is a top view thereof.
Figure 7:
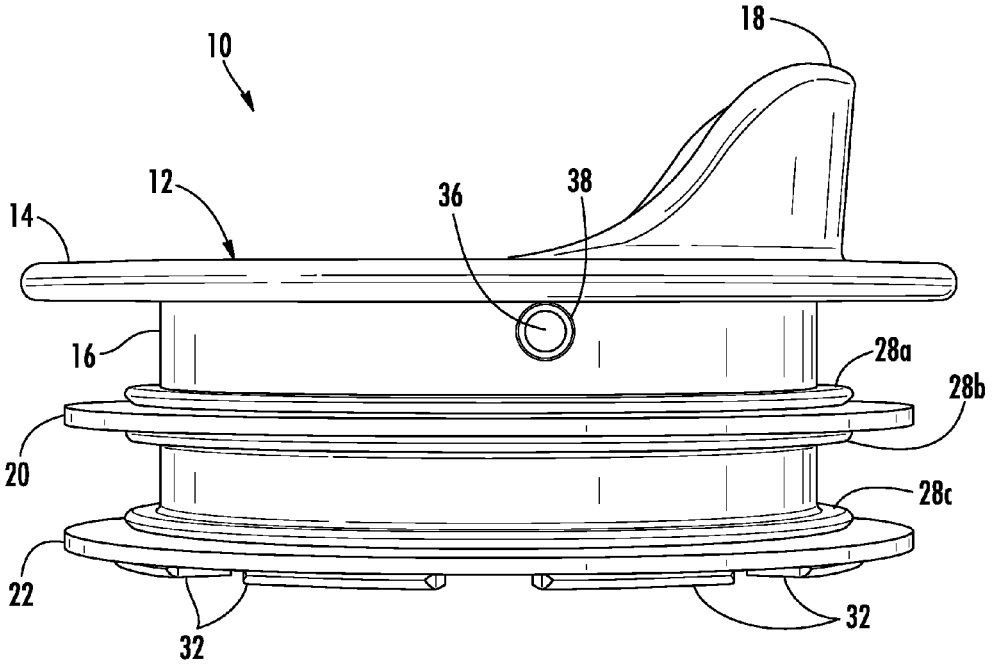
FIG. 7 is a left side elevation view thereof.
Figure 8:
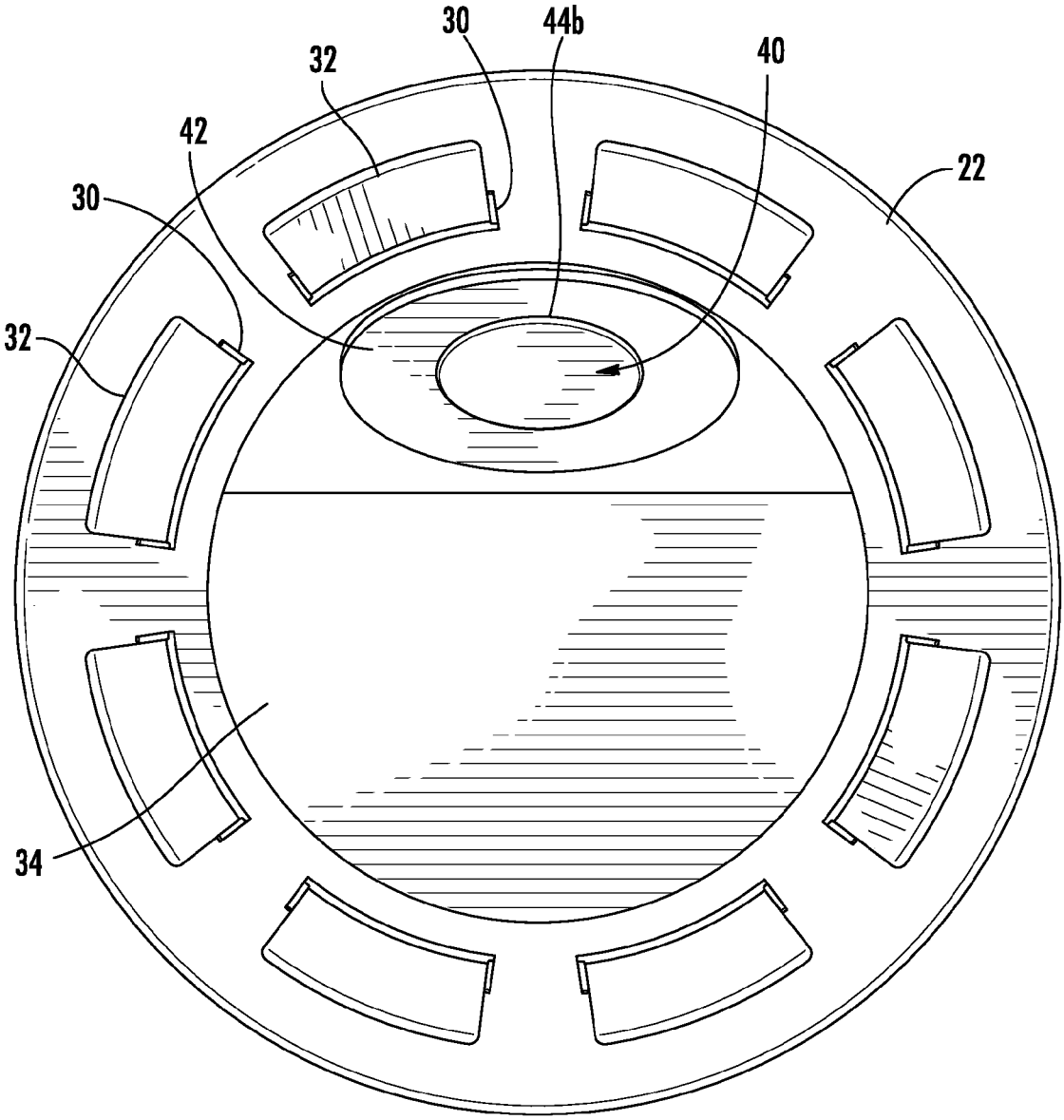
FIG. 8 is a bottom view of thereof.

Referring now to FIGS. 1-10, a first exemplary embodiment of a drinking cup lid constructed in accordance with the teachings of the present invention is shown generally at 10. The drinking cup lid 10 includes a body 12 having a deck 14 with an annular wall 16 depending from the deck 14. Extending upward from the deck 14 is a curved dispensing spout 18 that faces the front of the drinking cup lid 10. The annular wall 16 includes a pair of spaced apart sealing gaskets 20, 22 extending outwardly from the annular wall 16, which will be described further below. The drinking cup lid 10 further includes a closure 24 to prevent spillage and retain the heat in the contents of the drinking cup 26 (best seen in FIG. 10), which will also be described further below.

The annular wall 16 includes an outer surface adapted for insertion into a drinking cup 26, such as a common, household coffee mug, made of ceramic, glass or plastic and the like. The first and second gaskets 20,22 are generally planar, annular gaskets formed from sheets of a flexible, water resistant material, such as silicone. The first gasket 20 extends from outer surface of the annular wall 16 and is adapted to form a seal against the inner wall of a drinking cup 26. The inner edge of the first gasket 26 is retained to the outer surface of the annular wall 16 between a first annular rib 28*a* and a second annular rib 28*b*. The first annular rib 28*a* and the second annular rib 28*b* extend from the outer surface of the annular wall 16 and are spaced apart sufficient to fit the first gasket 20 and form a tight seal therebetween.

The second gasket 22 extends from outer surface of the annular wall and is also adapted to form a seal against the inner wall of a drinking cup 26. The second gasket 22 includes a number of slots 30 formed therethrough. Depending from the annular wall is an equal number of retaining elements 32 that interfit with the slots 30 on the second gasket 22. The retaining elements 32 hold the second gasket 22 onto the drinking cup lid 10. A third annular rib 28*c* extending from the outer surface of the annular wall 16 abuts the second gasket 22 and ensures a tight seal between the second gasket 22 and the annular wall 16 of the drinking cup lid 10.

Figure 9:
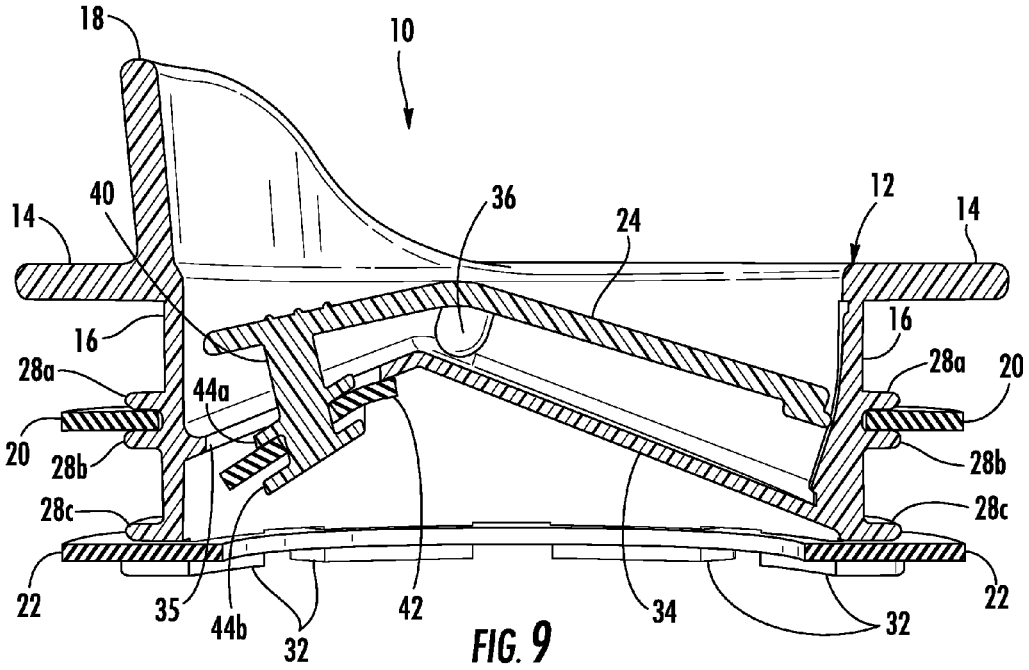
FIG. 9 is a cross-section view through line 9-9 of FIG. 1.
Figure 9A:
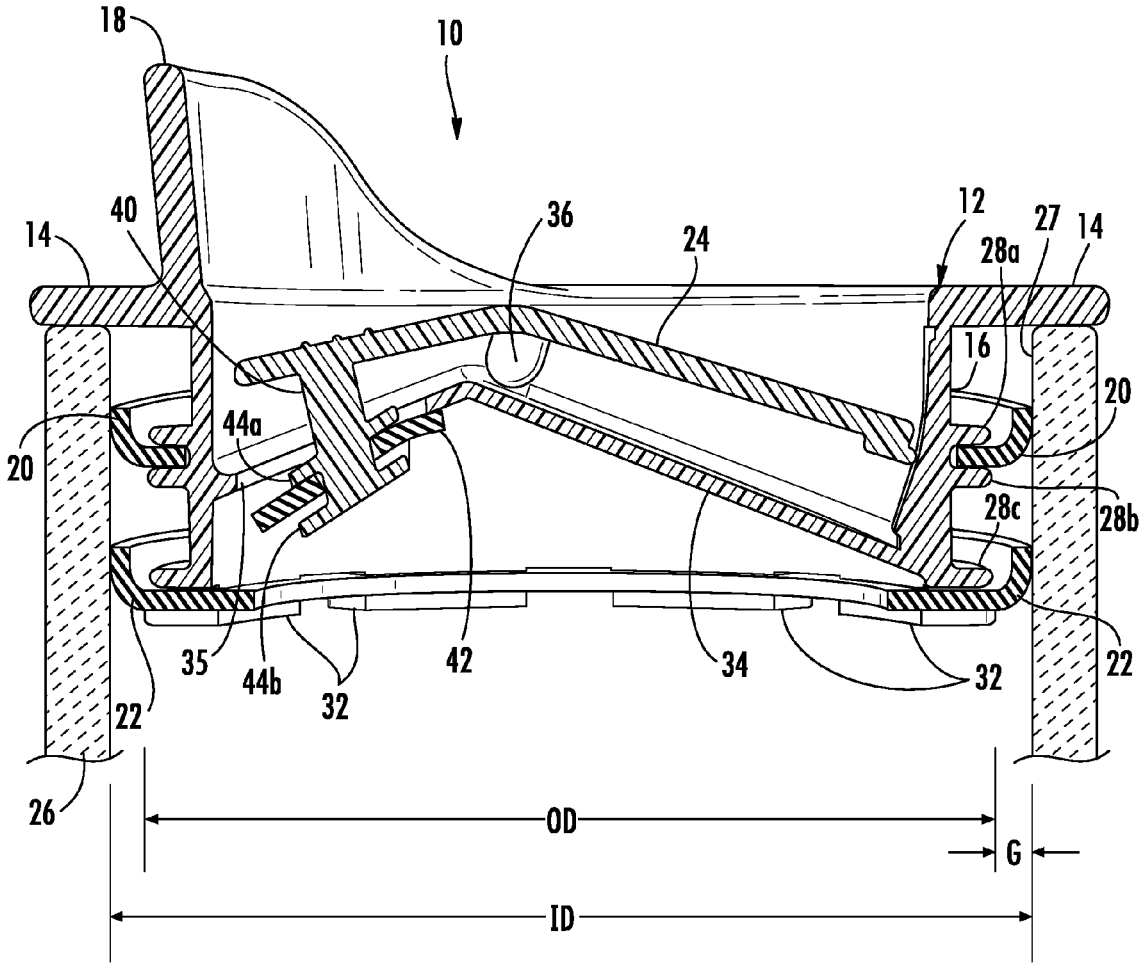
FIG. 9A is another cross-sectional view thereof showing the drinking cup lid received within the mouth of a cup.
Figure 10:
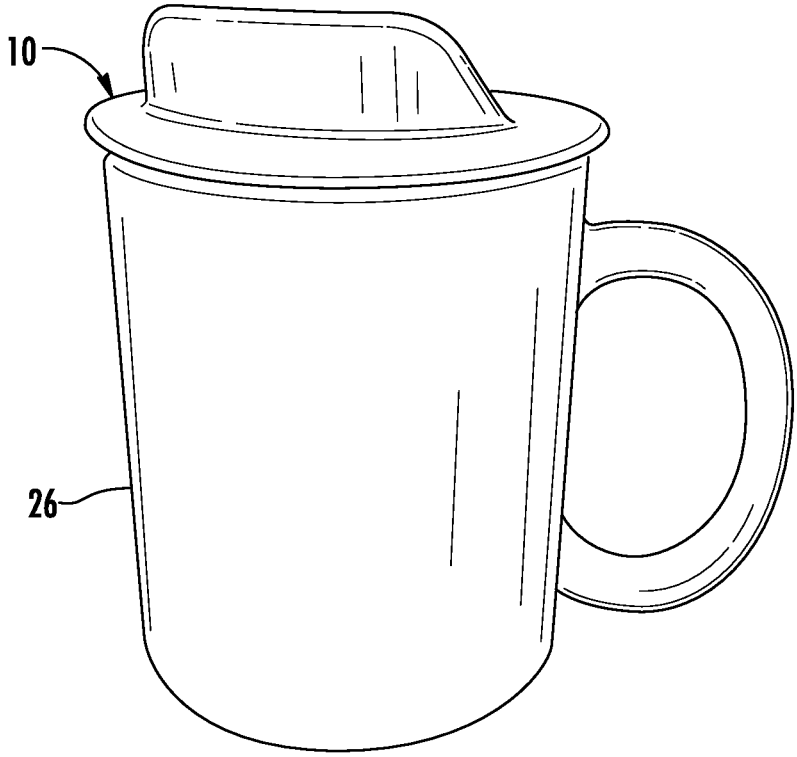
FIG. 10 is a perspective view thereof as mounted on a ceramic coffee mug.

Referring briefly to FIG. 9A, the cup 26 includes an inner wall 27 having an inner diameter ID. As will become apparent from FIG. 9A, the outer diameter (OD) of the retaining elements 32 are sized significantly smaller than the inner diameter (ID) of the cup 26 creating a large gap (G) therebetween. The large gap (G) accommodates the varying dimensions attendant with ceramic or glass cups and the irregularities of the surface of a ceramic or glass material. Because the present lid 10 is intended to be a universal solution, the lid 10 is provided with a smaller diameter annular wall 16 to fit within a large variation of sizes of mugs or cups, and is further provided with larger, i.e. wider, annular gaskets 20, 22 to bridge the gap (G) created between the outer surface of the annular wall 16 and the inner surface 27 of the cup 26.

In contrast, the cup and lid of standard travel cups are formed using exacting dimensions to eliminate any unnecessary gap between the lid and cup. Accordingly, there is virtually no gap seen in these cups and the seal is formed by small O-ring like gaskets.

The annular wall 16 further includes an inner surface. An upper wall 34 extends across the inner surface of the annular wall 16 and is connected thereto. An opening 35 is formed through the upper wall 34 to allow the contents of the drinking cup 26 to be dispensed therefrom.

The closure 24 is pivotally attached to the annular wall 16 by posts 36 which are received into openings 38 in the annular wall 16. The closure 24 may be pivoted forward or backward to open or close, respectively, the opening 35 in the upper wall 34. The closure 24 rocks on the rounded support 36 extending from the closure 24.

An appendage 40 depends from the closure 24 and down through the opening 35 on the upper wall 34. A third oval gasket 42 is received onto the appendage 40 and is adapted to seal the opening 35 on the upper wall 34 closed when the closure 24 is pivoted back to the closed positioned. A pair of spaced apart retaining ribs 44*a*, 44*b* holds the third gasket 42 on the appendage 40 of the closure 24. Pivoting the closure 24 backwards lifts the appendage 40 and causes the third gasket 42 to engage the opening 35 on the inner wall 34. Pivoting the closure 34 forwards lowers the appendage 40 and disengages the third gasket 42 from the opening 35 (See FIG. 9).

Figure 11:
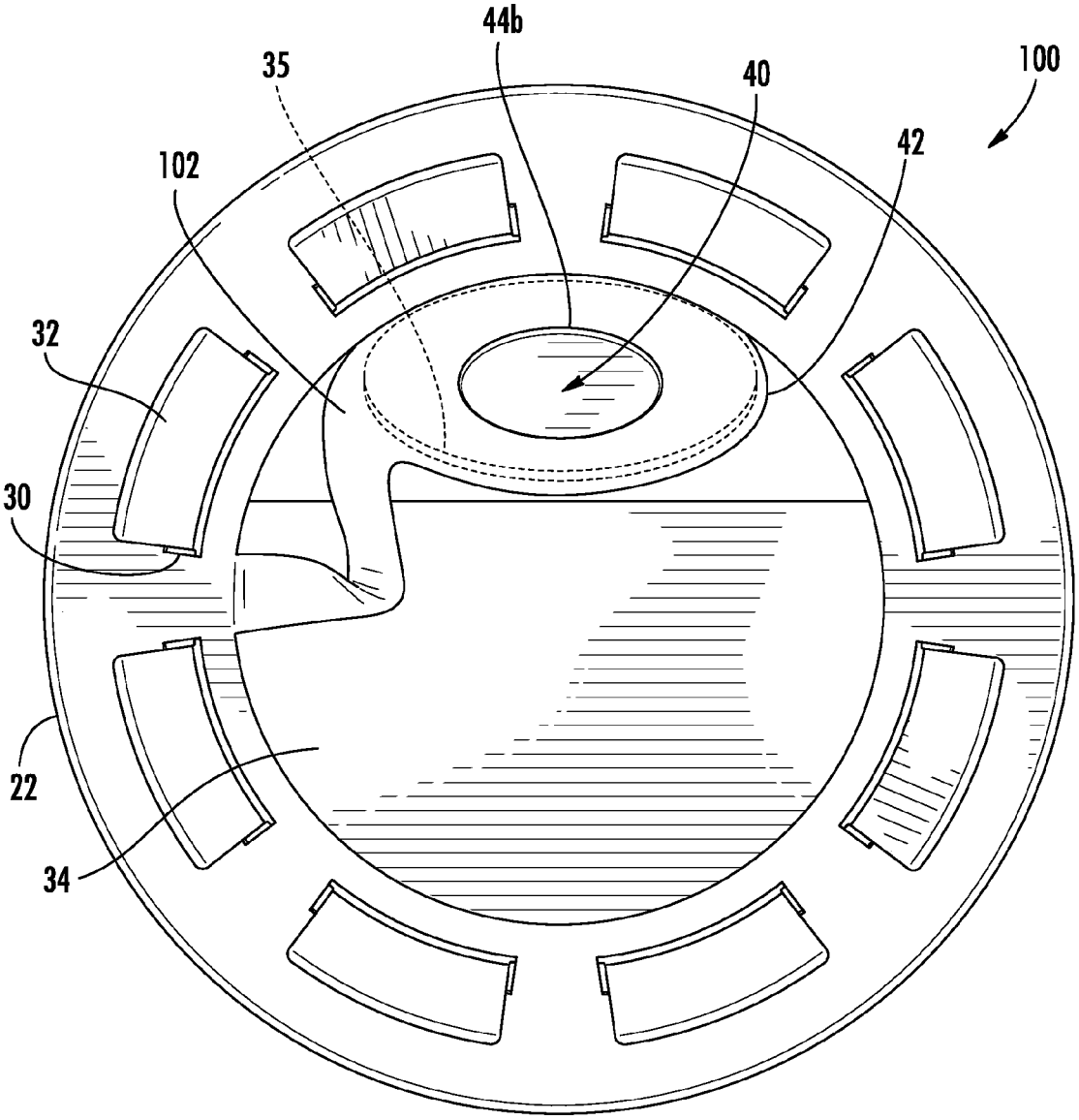
FIG. 11 is a bottom view of a second embodiment of a drinking cup lid including a tethered third gasket.

Referring to FIG. 11, a second exemplary embodiment of the drinking cup lid is shown generally at 100. The second embodiment 100 includes all the features and advantages of the first embodiment described above and shown in FIGS. 1-10. However, the third gasket 42 is now tethered to the second gasket 22 via a tether 102. The tether 102 prevents the third gasket 42 from becoming a choking hazard if it dislodges from the appendage 40.

Figure 12:
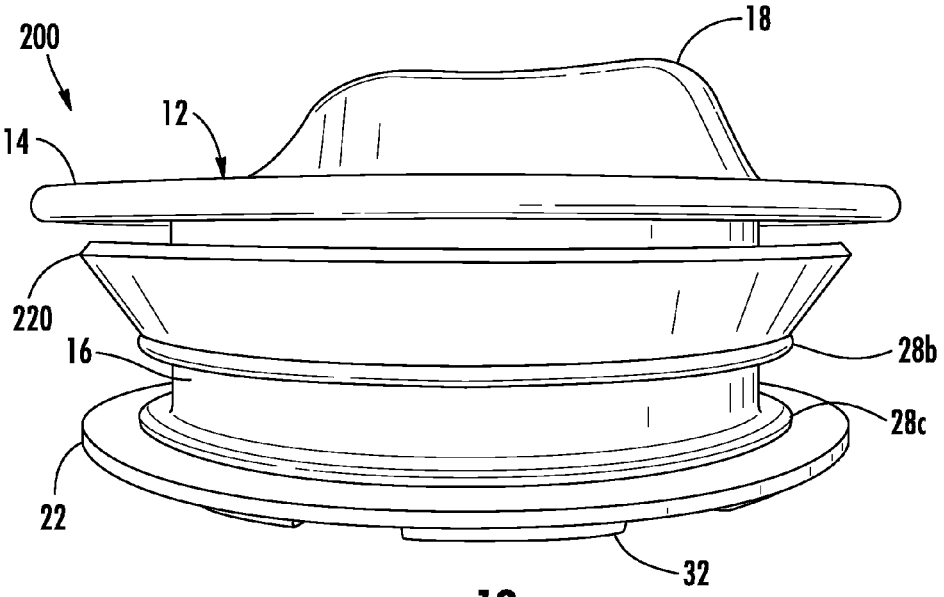
FIG. 12 is a rear elevation view of a third embodiment of a drinking cup lid including an upwardly pitched upper gasket.

Referring to FIG. 12, a third exemplary embodiment is indicated at 200 and includes a first gasket 220 that is pitched upwards towards the deck 14 of the drinking cup lid 100.

Figure 13:
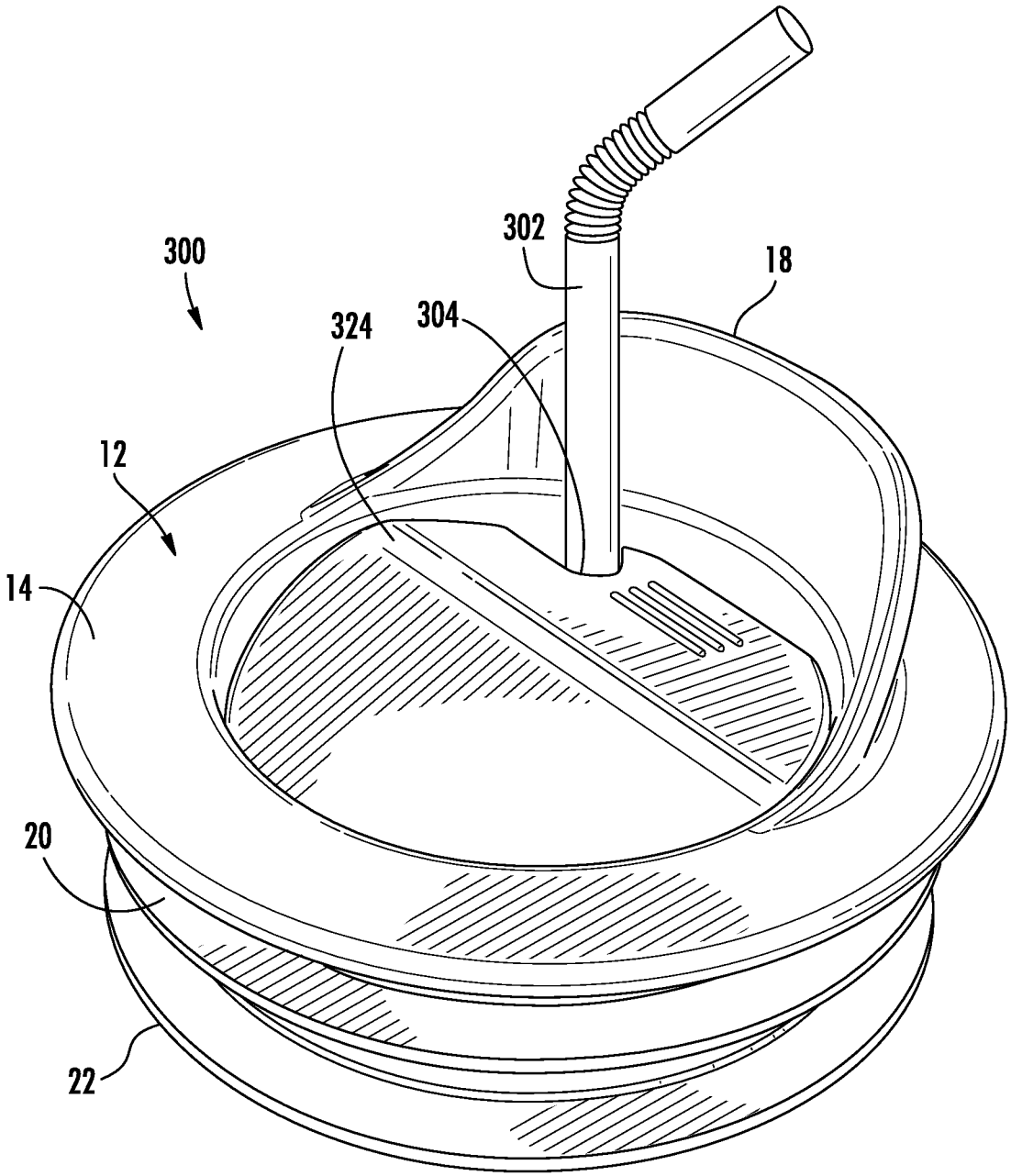
FIG. 13 is a rear perspective view of a fourth embodiment of a drinking cup lid.
Figure 14:
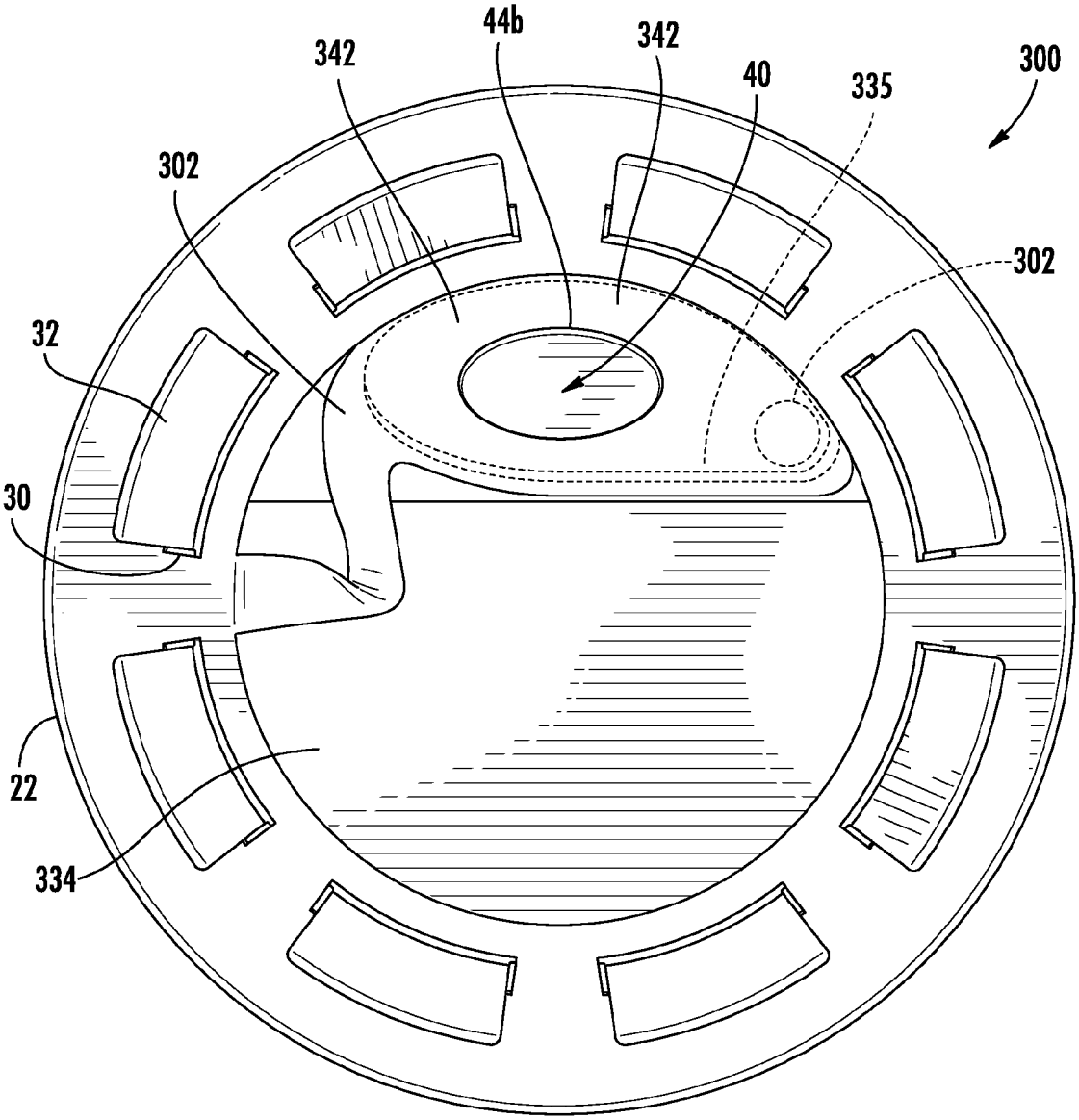
FIG. 14 is a bottom view thereof.

Referring to FIGS. 13 and 14, a fourth exemplary embodiment of the drinking cup lid is generally indicated at 300. The fourth embodiment 300 includes all the features and advantages of the second embodiment described above and shown in FIGS. 1-12 with some additional features. The fourth embodiment 300 adds the ability to use a straw 302 with the drinking cup 300. In this regard, the closure 324 includes a notch 304 at the side edge thereof to permit the straw 302 to extend down into the cup 26. Likewise, the opening 335 in the upper wall 334 is enlarged to the side to allow the straw 302 to pass by the upper wall 334. The lower gasket 22 is then modified by enlarging the size of the tethered third gasket 342 so that it is large enough to cover the opening 335. In this manner, the lid 300 can be used in either mode (without straw or with straw).

Figure 15:
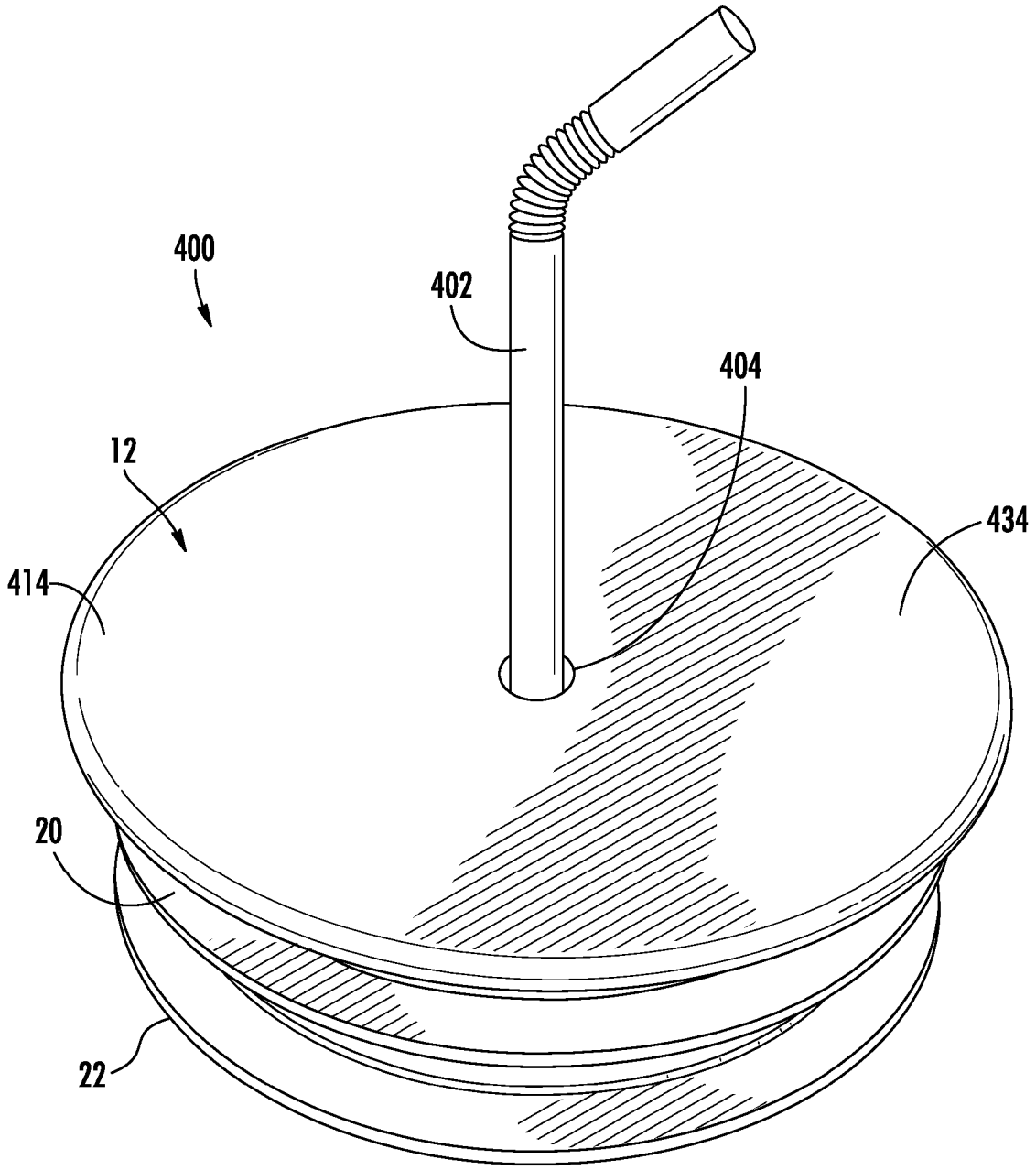
FIG. 15 is a front perspective view of a fifth embodiment of a drinking cup lid.
Figure 16:
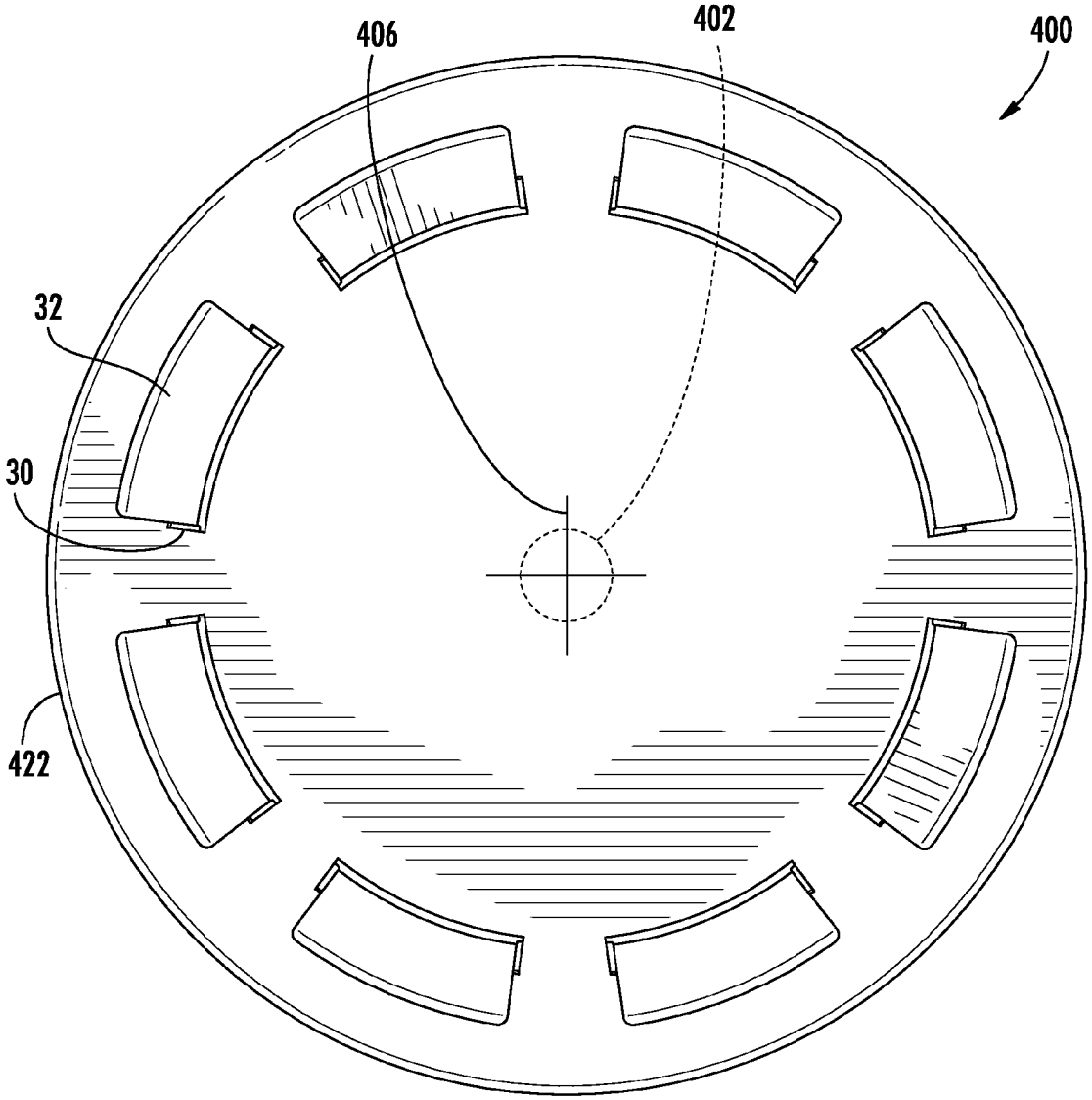
FIG. 16 is a bottom view thereof.

Referring to FIGS. 15 and 16, a fifth exemplary embodiment of the drinking cup lid is generally indicated at 400. The fourth embodiment 400 is a "straw only" version of lid which provides a lid 400 having the sealing gasket features of the earlier embodiments but only provides the ability to use a straw 402. In this regard, the closure 24 is eliminated and the upper wall 434 is modified to extend all the way across the upper portion of the lid deck 414. An opening 404 is provided in the upper wall 434 to allow the straw 402 to pass through the upper wall 434. The lower gasket 422 is then modified by removing the large central opening, removing the third gasket 42 and extending the gasket 422 all the way across the lid 400 to form a solid barrier. An X-shaped slit 406 is provided in the center of the gasket 422 to permit the straw 402 to pass through the gasket into the interior of the cup 26.

Figure 17:
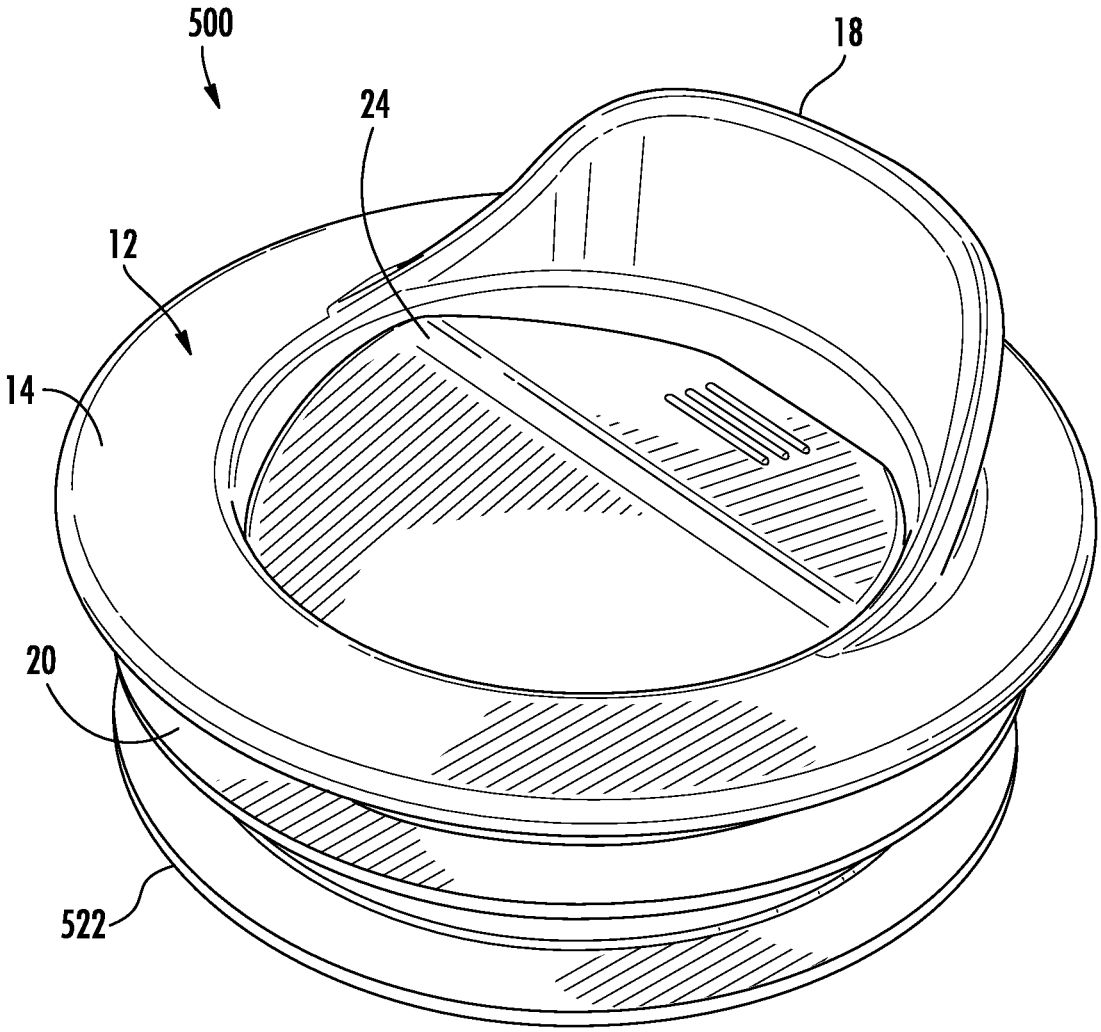
FIG. 17 is a rear perspective view of a sixth embodiment of a drinking cup lid.
Figure 18:
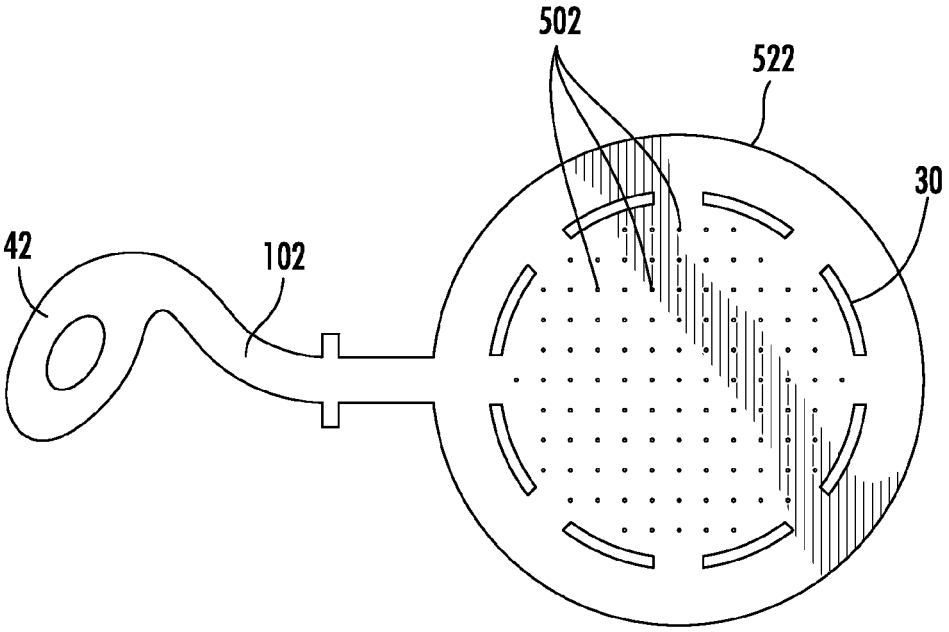
FIG. 18 is a plan view of the bottom gasket thereof.
Figure 19:
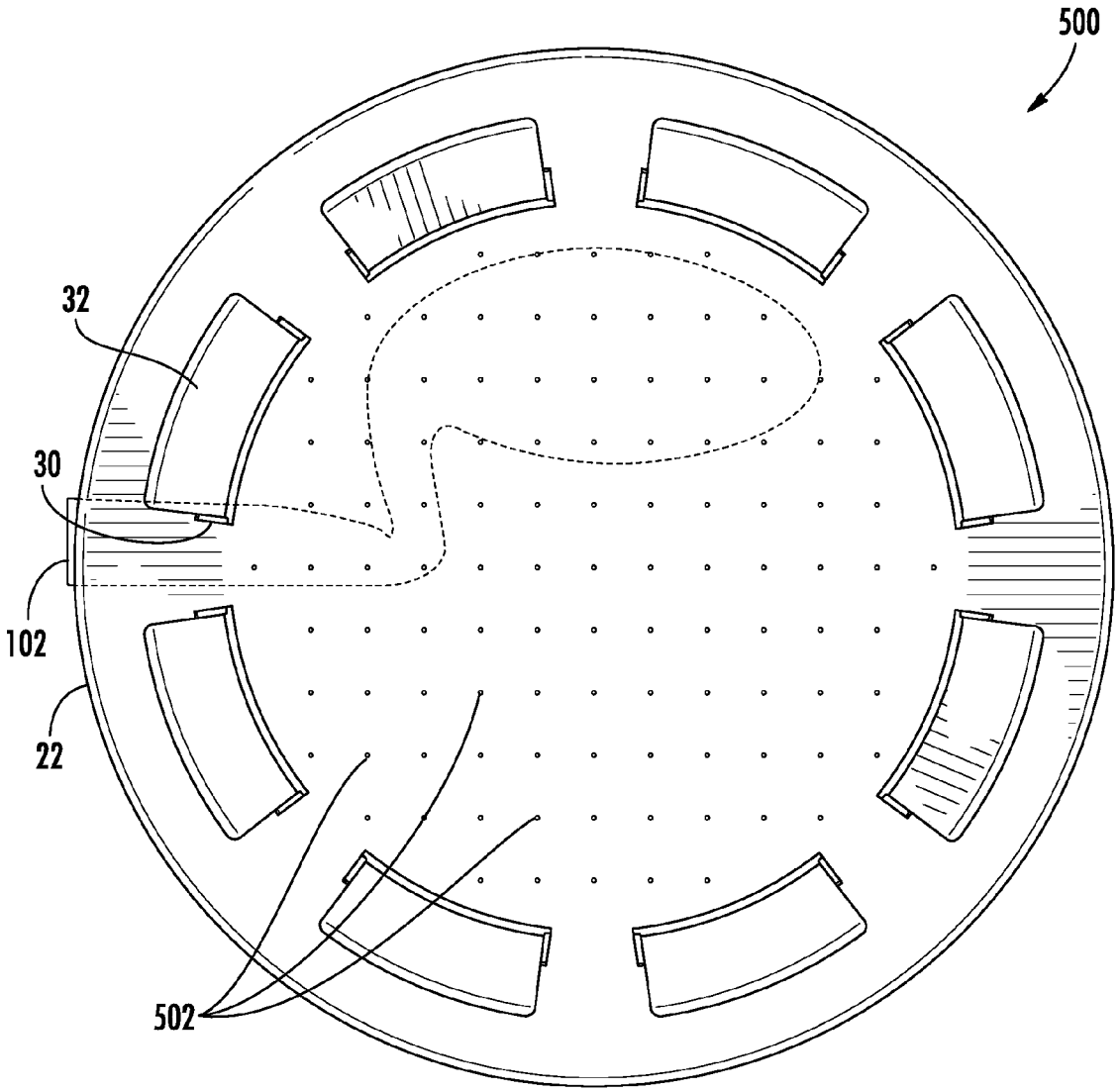
FIG. 19 is a bottom view of the drinking cup lid.

Finally, turning to FIGS. 17-19, a sixth exemplary embodiment of the lid is generally indicated at 500. This version includes an alternative lower gasket 522 which is solid across the bottom to cover the opening. However, the solid surface includes a plurality of small holes 502, preferably 40 micron holes, which are sized to strain tea leaves or coffee grounds. The tether 102 is slightly longer which allows it fold outside the outer edge of the gasket 522 and then back under to attach to the appendage 40 (see dotted lines FIG. 19). The use of the perforated gasket 522 allows one to put loose tea leaves or coffee grounds into a cup and add hot water and then drink the coffee or tea directly through the lid 500 strained through the gasket 522.

It would be appreciated by those skilled in the art that various changes and modifications can be made to the illustrated embodiments without departing from the spirit of the present invention. All such modifications and changes are intended to be within the scope of the invention except insofar as limited by the appended claims.

I claim:

1. A drinking cup lid, comprising:

a body having a deck with an annular wall depending downwardly therefrom adapted to insert into a ceramic or glass drinking cup having an irregular inner diameter (ID), the annular wall having an outer diameter (OD) sized significantly smaller than the inner diameter (ID) of the drinking cup creating a large variable gap (G) therebetween;

an oversized first gasket extending outwardly from the annular wall for sealing engagement with the drinking cup, the first gasket having an outer diameter which is substantially larger than the inner diameter of the drinking cup, the first gasket removable from the annular wall;

an oversized second gasket extending outwardly from the annular wall for sealing engagement with the drinking cup, the second gasket having an outer diameter which is substantially larger than the inner diameter of the drinking cup, the second gasket removable from the annular wall;

a closure pivotally attached to the annular wall and configured and arranged to pivot between a closed position, sealing the generic drinking cup closed, and an open position, opening the drinking cup; and a third gasket connected to the closure and tethered to the second gasket;

wherein said smaller outer diameter (OD) of said annular wall and said oversized first and second gaskets accommodate the varying dimensions and irregularities of the variable gap (G), yet support the drinking cup lid securely within the variably sized drinking cups without being easily dislodged therefrom.

2. The drinking cup lid of claim 1, further comprising a dispensing spout extending upwards from the deck.

3. The drinking cup lid of claim 1, wherein the first gasket is retained to the annular wall between two, symmetrical spaced-apart annular ribs.

4. The drinking cup lid of claim 1, wherein the second gasket comprises a plurality of slots configured and arranged to attach to a plurality of retaining elements depending from the annular wall.

5. The drinking cup lid of claim 4, further comprising an annular rib extending from the annular wall, the annular rib abutting the second gasket.

6. The drinking cup lid of claim 1, further comprising an upper wall extending across an inner surface of the annular wall, the upper wall having a dispensing orifice.

7. The drinking cup lid of claim 1, wherein the closure is pivoted on the annular wall via a rounded support.

8. The drinking cup lid of claim 6, wherein the closure further comprises an appendage depending downwardly supporting the third gasket, the third gasket further adapted for sealing engagement with the dispensing orifice.

9. A drinking cup lid, comprising:

a body having a deck with an annular wall depending downwardly therefrom adapted to insert into a drinking cup;

a first gasket extending outwardly from the annular wall for sealing engagement with the drinking cup;

a second gasket extending outwardly from the annular wall for sealing engagement with the drinking cup;

a closure pivotally attached to the annular wall and configured and arranged to pivot between a closed position, sealing the drinking cup closed, and an open position, opening the drinking cup; and a third gasket connected to the closure and tethered to the second gasket.

10. The drinking cup lid of claim 9, further comprising a dispensing spout extending upwards from the deck.

11. The drinking cup lid of claim 9, wherein the first gasket is retained to the annular wall between two spaced-apart annular ribs.

12. The drinking cup lid of claim 9, wherein the second gasket comprises a plurality of slots configured and arranged to attach to a plurality of retaining elements depending from the annular wall.

13. The drinking cup lid of claim 12, further comprising an annular rib extending from the annular wall, the annular rib abutting the second gasket.

14. The drinking cup lid of claim 9, further comprising an upper wall extending across an inner surface of the annular wall, the upper wall having a dispensing orifice.

15. The drinking cup lid of claim 9, wherein the closure is pivoted on the annular wall via a rounded support.

16. The drinking cup lid of claim 14, wherein the closure further comprises an appendage depending downwardly having the third gasket thereon adapted for sealing engagement with the dispensing orifice.

17. A drinking cup lid, comprising:

a body having a deck with an annular wall depending downwardly therefrom adapted to insert into a drinking cup;

a first gasket extending outwardly from the annular wall for sealing engagement with the drinking cup;

a second gasket extending outwardly from the annular wall for sealing engagement with the drinking cup, the second gasket further extending inwardly from an innermost surface of the annular wall, the second gasket removably attached to the annular wall; and a closure pivotally attached to the annular wall and configured and arranged to pivot between a closed position, sealing the drinking cup closed, and an open position, opening the drinking cup.

18. A drinking cup lid, comprising:

a body having a deck with an annular wall depending downwardly therefrom adapted to insert into a drinking cup, the annular wall comprising a plurality of retaining elements depending therefrom;

a first gasket extending outwardly from the annular wall for sealing engagement with the drinking cup;

a second gasket extending outwardly from the annular wall for sealing engagement with the drinking cup, the second gasket comprising a plurality of slots configured and arranged to attach to the plurality of retaining elements, the second gasket extending around each retaining element, directionally outwardly from the annular wall and directionally inwardly from an innermost surface of the annular wall, the second gasket removably attached to the annular wall;

a closure pivotally attached to the annular wall and configured and arranged to pivot between a closed position, sealing the drinking cup closed, and an open position, opening the drinking cup.

* * * * *

UNITED STATES PATENT AND TRADEMARK OFFICE

CERTIFICATE OF CORRECTION

PATENT NO. : 9,027,774 B2
APPLICATION NO. : 13/412651
DATED : May 12, 2015
INVENTOR(S) : Douglas Palmer It is certified that error appears in the above-identified patent and that said Letters Patent is hereby corrected as shown below:

In the Drawings

Sheet 9 of 20, Fig. 9 (also used as title page figure), “36” should read --37--; and Sheet 10 of 20, Fig. 9A, “36” should read --37--.

In the Specification

Column 3, line 29, “rounded support 36” should read --rounded support 37--.

Signed and Sealed this
Twenty-ninth Day of December, 2015

Michelle K. Lee

Michelle K. Lee
*Director of the United States Patent and Trademark Office*